US008764897B2

(12) United States Patent
Aoki et al.

(10) Patent No.: US 8,764,897 B2
(45) **Date of Patent: *Jul. 1, 2014**

(54) OIL TYPE RELEASE AGENT FOR DIE CASTING METHOD FOR GETTING SOLVENT MIXING RATIO, CASTING METHOD, AND SPRAY UNIT

(75) Inventors: Hisaharu Aoki, Tokyo (JP); Koji Togawa, Tokyo (JP); Hirobumi Ohira, Tokyo (JP); Masanao Kobayashi, Tokyo (JP); Hiroaki Komatsubara, Tokyo (JP); Toshiaki Shimizu, Tokyo (JP); Ryusuke Izawa, Fuchu (JP); Masayuki Harada, Nishio (JP); Masayuki Kito, Obu (JP); Keigo Yorioka, Obu (JP); Akihiro Hayashi, Obu (JP)

(73) Assignees: Aoki Science Institute Co., Ltd., Tokyo (JP); Ryobi Ltd., Fuchu-Shi (JP); Kotobuki Kinzoku Kogyo Co., Ltd., Nishio-Shi (JP); Aisan Industry Co., Ltd., Obu-Shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/371,452

(22) Filed: Feb. 12, 2012

(65) Prior Publication Data

US 2012/0208939 A1 Aug. 16, 2012

Related U.S. Application Data

(63) Continuation of application No. 11/703,708, filed on Feb. 8, 2007, now Pat. No. 8,114,209, which is a continuation of application No. PCT/JP2005/015737, filed on Aug. 30, 2005.

(30) Foreign Application Priority Data

| | | |
|---|---|---|
| Aug. 31, 2004 | (JP) | 2004-252056 |
| Apr. 4, 2005 | (JP) | 2005-107556 |
| May 30, 2005 | (JP) | 2005-157616 |

(51) Int. Cl.

| | |
|---|---|
| ***B28B 7/38*** | (2006.01) |
| ***B28B 7/36*** | (2006.01) |
| ***C04B 35/66*** | (2006.01) |
| ***C10M 105/36*** | (2006.01) |
| ***C10M 131/10*** | (2006.01) |

(52) U.S. Cl.
USPC ..... 106/38.22; 508/496; 508/370

(58) Field of Classification Search
USPC ..... 106/38.22; 524/186, 261; 508/496, 370
See application file for complete search history.

(56) References Cited

U.S. PATENT DOCUMENTS

| | | | | |
|---|---|---|---|---|
| 3,923,671 | A * | 12/1975 | Knepp | 508/495 |
| 4,844,830 | A * | 7/1989 | Budd et al. | 508/505 |
| 8,114,209 | B2 * | 2/2012 | Aoki et al. | 106/38.22 |
| 8,114,290 | B2 * | 2/2012 | Beldring et al. | 210/327 |

(Continued)

FOREIGN PATENT DOCUMENTS

| | | | |
|---|---|---|---|
| EP | 0440476 | * 11/1992 | B29C 33/64 |

*Primary Examiner* — Shuangyi Abu Ali
(74) *Attorney, Agent, or Firm* — Baker & Hostetler LLP

(57) ABSTRACT

An oil type release agent is provided, containing 70 to 98 parts by weight of solvents having dynamic viscosity of 2 to 10 $mm^2/s$ at 40° C. and a flash point in the range of 70 to 170° C., 1 to 10 parts by weight of high viscosity mineral oils and/or synthetic oils having dynamic viscosity of 100 $mm^2/s$ or higher at 40° C., 15 parts by weight or less of a silicone oil having dynamic viscosity of 150 $mm^2/s$ or higher at 40° C., and 1 to 5 parts by weight of additives having a lubricating function. The flash point of the agent is in the range of 70 to 170° C., and the dynamic viscosity of the agent is 2 to 30 $mm^2/s$ or higher at 40° C.

15 Claims, 6 Drawing Sheets

OIL TYPE RELEASE AGENT FOR DIE CASTING METHOD FOR GETTING SOLVENT MIXING RATIO, CASTING METHOD, AND SPRAY UNIT

CROSS REFERENCE TO RELATED APPLICATIONS

This is a Continuation of U.S. patent application Ser. No. 11/703,708, filed on Feb. 8, 2007, which is a Continuation of International PCT application Ser. No. PCT/JP2005/015737, filed Aug. 30, 2005, the disclosures of which are incorporated herein by reference in their entirety.

This application is based upon and claims the benefit of priority from prior Japanese Patent Applications No. 2004-252056, filed Aug. 31, 2004; No. 2005-107556, filed Apr. 4, 2005; and No. 2005-157616, filed May 30, 2005, the entire contents of all of which are incorporated herein by reference.

BACKGROUND OF THE INVENTION

1. Field of the Invention

The present invention relates to an oil type release agent for die casting, a method for setting a solvent mixing ratio, a casting method using the oil type release agent, and a spray unit. The invention is also applicable for a plunger chip as a lubricant.

2. Description of the Related Art

As is well known, in die casting, to lubricate the cavity part of a die, an oil film is formed on the cavity surface of the die by spraying a lubricant called as a release agent after die opening. The oil film prevents a cavity from soldering of a non-ferrous molten metal of such as aluminum, magnesium and zinc on the cavity and makes possible casting continuously. The release agents for die casting are broadly classified into the oil type release agent and a water soluble type release agent. In terms of the productivity, the safety, and the work environments, the water soluble type release agent has often been used in recent years.

However, before 40 years ago, a release agent was only oil type (hereinafter, referred to as old oil type release agent) containing solid matters of lard, powder and graphite with which machinery is made sticky after use. Users diluted the agent with an economical kerosene or solvent and sprayed the diluted agent. However since the old oil type release agent contained a powder, the powder scattered in the peripheral areas of the die during casting, worsened the work environments and deposited on the die. Thus frequent cleaning was indispensable. The old oil type release agent was mixed with kerosene which had a low flash point. It was so risky as to cause a fire and thus made automation of die casting difficult. Because of this reason, the old oil type release agent was applied manually, resulting in low production efficiency. Further, since the refining degree of the kerosene was low and trace components such as sulfur or the like were contained, the agent might inevitably cause adverse effects on the human body and emitted intense oily smell. That is, the old oil type release agent had risks of fire and explosion, was unsuitable for automation, polluted the working environments with oil and powders, and inevitably required periodic cleaning works.

Because of the above described situations, the old oil type release agent was changed to the water soluble type release agent with less risk of firing for automation. It is no exaggeration to say that 99% of release agents made commercially available are water-soluble-type release agents now. On the other hand, very a few oil type release agents containing no solid matter (hereinafter, referred to simply as highly viscid oil type release agent) have continuously been used. Such oil type release agents have an excellent lubricating property. However, the viscosity is very high (dynamic viscosity at 40° C. is 100 $mm^2/s$ or higher) and even if they are sprayed, the produced mist has a large diameter. Therefore, the agents are unsuitable for automatic spraying and consequently consumed much, and the oil components of them are entrained and gasified in the flow of molten metal to remain in the form of gas in cast products and accordingly result in increase of the porosity. Consequently, utilizing the excellent lubricating property of them, the old oil type release agents have presently been used only for warm-up operation before applying the water soluble type release agent.

On the other hand, the water soluble type release agent free from the risk of the fire has a crucial defective point in the capability. Since the agent is diluted with water about 80 times as much at the time of use, 99% of the main component are water and therefore the agent causes Leidenfrost phenomenon on the die at around 150° C. That is, the release agent mist is explosively evaporated around 150° C. and the die surface is covered with a steam film. Therefore the release agent mist, which comes next, cannot arrive at the die surface. This causes the decrease of the adhesion amount of active components in the release agent on the die surface. To increase the adhesion amount, the die temperature is kept below the Leidenfrost temperature by spraying a large quantity of the water soluble type release agent while scarifying the adhesion efficiency. As a matter of fact, presently the spray amount is approximately the same as the number of the tons of the locking force of a casting machine (e.g. about 350 cc for a 350 t-machine, about 2500 cc for a 2500 t-machine). Naturally, the peripheral areas of the machine become dirty, the waste fluid is much, thereby it is required much labor and cost for cleaning and waste fluid treatment. Also, since almost all the water soluble type release agents contain waxes, solidified waxes adhere to the die surface and deposit to peripheral areas of the machine. It requires frequent cleaning. Not only the pollution in the peripheral areas of the machine due to the precipitation and adhesion of the release agent's components, but also oxidation deterioration of the components has to be taken into consideration. Patent Document 1 (Jpn. Pat. Appln. KOKAI Publication No. 8-103913) describes the use of an oxidation prevention agent for suppressing oil component deterioration in the water soluble type release agent. The invention aims the pollution prevention of a die in a rubber vulcanization process. And it also discloses a countermeasure for apparently decreasing stains on the die.

Further, the die is heated to about 200 to 350° C. with aluminum molten metal every shot and thereafter cooled to about 100 to 150° C., with the water soluble type release agent. The temperature of the die surface fluctuates from 100 to 200° C. in every shot. Consequently, after continuous casting for a long duration (several thousand times for a large scale die and several ten thousand times for a small scale die), thermal fatigue is accumulated in the die surface, so-called cracks are formed and finally the costly die is broken. This is the present situation.

Further, since the water soluble type release agent has a strong cooling capability, the molten aluminum injected into the cavity is cooled within a short time. The viscosity of the molten metal is increased to disturb the molten metal flow. Finally the molten metal can not reach to every fine corner of the cavity. As a result, so-called "misrun" and "shrinkage" phenomena occur and make it impossible to produce a complete cast product. Also, since the adhesion efficiency of the water soluble type release agent is low, the oil film on the metal surface is thin. Soldering may often occur at high temperature portions of the die, especially thin parts like core pins.

Porosity, which decreases the strength of the cast product, is also a problem. The cause of the porosity is to entrain organic matters and water into turbulent flow of the molten metal and to gasify in the casting product. If an excessive amount of the release agent is sprayed, the porosity increases. In the past, to lower the porosity, Patent Document 2 (Jpn. Pat. Appln. KOKAI Publication No. 2000-33457) disclosed a powder type release agent having excellent releasing capabilities.

In the above-mentioned current situation, it has been desired to improve the disadvantageously low adhesion efficiency of the water soluble type release agent, to improve the spraying property of highly viscus oil type release agent while keeping the excellent lubrication property, and to make it possible to achieve "very small amount of spray", "long die lie" and "less waste fluid".

BRIEF SUMMARY OF THE INVENTION

The present invention aims to provide the oil type release agent without formulating water. The oil type release agent enables the long die, life less waste fluid, excellent releasing lubricating property at a high temperature and very small amount of spray. By setting appropriate viscosity at 40° C., very small amount of spray is achieved resulting in less vapor scatting in air.

Also, the invention aims to provide a setting method of a solvent mixing ratio at which the Leidenfrost phenomenon can be avoided by setting the mixing ratio of two kinds of solvents, or a solvent with mineral oils and/or synthetic oils at the time of die casting using the above-mentioned oil type release agent for die casting.

Further, the invention aims to provide the oil type release agent for die casting, a casting method, and a spraying unit by which the spraying amount can be saved as compared with that in conventional methods and problems such as galling, flow line, metal wave, and porosity can be solved.

1) In order to achieve the above-described objects, the oil type release agent of the invention (first invention) contains: (a) 70 to 98 parts by weight of solvents having dynamic viscosity of 2 to 10 $mm^2/s$ at 40° C. and having the flash point in the range of 70 to 170° C.; (b) 1 to 10 parts by weight of a high viscosity mineral oils and/or synthetic oils having dynamic viscosity of 100 $mm^2/s$ or higher at 40° C.; (c) 15 parts by weight or less of a silicone oil having dynamic viscosity of 150 $mm^2/s$ or higher at 40° C.; and (d) 1 to 5 parts by weight of the additives having a lubricating capability, wherein the flash point of the agent is in the range of 70 to 170° C., and dynamic viscosity of the agent is 2 to 30 $mm^2/s$ at 40° C.

According to the first invention, the oil type release agent contains no water to avoid inhibition of the lubricating property and provides lubrication because of oil components. It is particularly excellent in the releasing lubricating property at the high temperature. Further, since no water is contained, the die is not cooled with the release agent. Thus the die life is prolonged, the scattering of the agent in air is decreased and the die casting is carried out free from the waste fluid. Particularly, the agent is suitable for automatic continuous spraying and excellent in application of a small amount of a neat liquid and wettability. Further, according to the first invention, the oil type release agent enables the smaller spraying amount than the conventional agent and the reduction of die casting problems such as galling, flow line, metal wave and porosity.

2) The invention (the second invention) provides a method for setting a mixing ratio of the solvent in the oil type release agent to avoid Leidenfrost phenomenon at the time of die casting. Two or more kinds of solvents can be used as the solvents for mixing. The method consists of the first, second, third and fourth steps. The first step is to interpolate the expected highest use temperature (S) in the following equations (1) and (2) for calculating a needed flash point (F) of the release agent to be formulated. The second step is to measure flash points for three or more different release agents having different concentrations of the respective solvents. The third step is to make a graph on the correlation between the % values by weight of the solvent in each release agent and the flash point of each release agent. The fourth step is to estimate the % value by weight of the solvent in the release agent to be formulated from the graph and the needed flash point which was calculated from in the first step.

$$S+80=L \quad (1)$$

$$L=4.4\times F+36 \quad (2)$$

where S denotes the highest temperature for use of a release agent; L denotes Leidenfrost phenomenon temperature; and F denotes the flash point of the release agent.

According to the second invention, it is possible to avoid Leidenfrost phenomenon at the time of die casting using the oil type release agent.

3) The invention (the third invention) provides a method for setting a mixing ratio of the solvent with the mineral oil and/or synthetic oil. The purpose is to avoid Leidenfrost phenomenon at the time of die casting using the oil type release agent according to claim 1. The method comprises the steps of interpolating an expected highest use temperature (S) in the above equations (1) and (2) for calculating an flash point (F) of a release agent; preparing three or more different release agents having different concentrations of the respective solvents, mineral oils and/or synthetic oils; investigating the flash point for each prepared release agent; producing a graph of the correlation of the % by weight of the solvent in each release agent and the flash point of each release agent; and calculating the % by weight of the solvent in the release agent from the graph and the flash point calculated from the equations (1) and (2).

The third invention has the same effect as that of the second invention.

4) A casting method of the invention (the fourth invention) involves die casting by using the oil type release agent of the above-mentioned 1) with a release agent application machine. According to the fourth invention, the casting method capable of die casting using the oil type release agent of the first invention is provided.

5) A spray unit of the invention (the fifth invention) is the spray system for spraying and applying the oil type release agent according to the above-described 1) to a die. This system comprises a release agent spray unit with multiple spray nozzles to apply the oil type release agent to the die surface and a pressurized delivery unit which supplies the release agent under a low pressure condition to the spray unit and applies the small amount of the release agent to the die. According to the fifth invention, it is possible to spray the oil type release agent which is described in the first invention.

6) The invention (the sixth invention) provides a casting method for carrying out die casting using the spray unit according to the above-described 4) and the oil type release agent.

DETAILED DESCRIPTION OF THE INVENTION

Figure 1A:
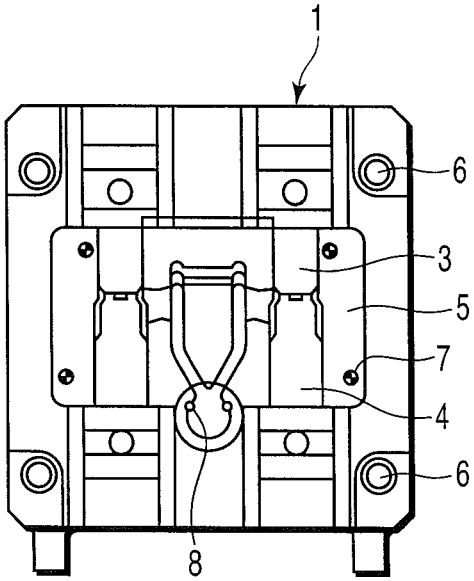
FIG. 1A is a front view of a movable die employed in Examples of the invention.

Hereinafter the invention will be described in detail.

(1) The oil type release agent for die casting of the invention (the first invention) contains (a) 70 to 98 parts by weight of solvents having dynamic viscosity of 2 to 10 $mm^2/s$ at 40° C. and the flash point in the range of 70 to 170° C.; (b) 1 to 10 parts by weight of the mineral oils and/or synthetic oils having dynamic viscosity of 100 $mm^2/s$ or higher at 40° C.; (c) 15 parts by weight or less of a silicone oil having dynamic viscosity of 150 $mm^2/s$ or higher at 40° C.; and (d) 1 to 5 parts by weight of additives having a lubricating function, wherein the flash point of the agent is in the range of 70 to 170° C., and dynamic viscosity of the agent is 2 to 30 $mm^2/s$ at 40° C.

(2) The component (a) of the above-mentioned (1) is a highly volatile and low viscosity component and is to be evaporated in the die surface. In this connection, taking the effect on the human body into consideration, any solvents with high polarity such as alcohols, esters, and ketones should not be used, and a petroleum type solvent containing mostly saturated components and a low viscosity base oil are preferable. Examples of them are saturated solvents and low viscosity synthetic oils which are highly refined to suppress a sulfur component to 1 ppm or lower. The dynamic viscosity at 40° C. is specified to be of 2 to 10 $mm^2/s$ in the above-mentioned (a). When the viscosity of the solvent is too low like 2 $mm^2/s$ or lower, the viscosity of entire release agent becomes too low as well. On the other hand, when the viscosity of the solvent is too viscous like 10 $mm^2/s$ or higher, the viscosity of entire release agent becomes too viscous as well. Further, the ratio of the above-mentioned (a) is adjusted to be 70 to 97 parts by weight for optimizing volatile of the entire release agent.

(3) The flash point of the above-mentioned component (a) of (1) is adjusted to be in the range of 70° C. to 170° C. because of the following reasons. That is, to form a thick oil film on the die surface, just like the case of a quick dry type paint, it is better to evaporate solvents so quickly as to avoid dripping of once adhered components from the die surface. Therefore it is desirable to have a high evaporation speed. However, if the evaporation speed is too fast, Leidenfrost phenomenon may occur as seen with the water soluble type release agent. Therefore those solvents having a high evaporation speed like gasoline are not preferable. Further, if the evaporation is fast, the flash point becomes low resulting in a high risk of a fire accident. Accordingly, the flash point is adjusted to be higher 43° C., which is the flash point of old oil type release agents containing kerosene. And it is preferable to be higher than the flash point (70° C.) of automotive diesel fuel from the practical standpoint. Therefore, the flash point of the composition of the invention is defined to be 70° C. or higher.

On the other hand, in the case of the die with a high temperature, the higher flash point is preferable to suppress the evaporation property of the release agent. However the viscosity of the release agent also becomes higher. If the viscosity is high, the sprayed state of the release agent is worsened. There should be an upper limit on viscosity. The upper limit of the viscosity corresponds to the flash point of 170° C. and accordingly, the flash point is determined to be 170° C. or lower.

With respect to the (a) component of the above-mentioned (1), mineral oils and/or synthetic oils with low viscosity may be added to the above-mentioned solvents to adjust the amount to be 70 to 98 parts by weight in total. In the case where the (a) component is only solvent, two or more kinds of solvents may be used. In the case of no adjustment on the basis of Leidenfrost phenomenon, one kind of solvent may be used alone.

(4) The mineral oils and/or synthetic oils with high viscosity, which are the component (b) of the above-mentioned (1), are adhered on the die surface. The adhered components consequently make the lubricating film thick at a temperature range of about 150 to 300° C. and accordingly take a role of keeping the lubrication. These components are required to have an appropriate viscosity at the die temperature to prevent dripping of the adhering oil from the die surface for several seconds which correspond to the time from spray to injection of molten metal. However, the die temperature differs in a respective die machine. Even in the same machine, the temperature differs in the portions of the die. Therefore, the die temperature is assumed to be 150° C. or higher in the entire body and the dynamic viscosity of the mineral oils and/or synthetic oils with high viscosity at 40° C. is adjusted to be 100 $mm^2/s$ or higher.

Further, if the mixing amount of the (b) component is low, the lubricating film on the die surface becomes thin. If the mixing amount is too high, problems may occur. One is that spraying state becomes instable. The other is that the thick lubricating film may causes the appearance change of a cast product partially (so-called remaining color). To deal with these problems, the addition amount of the component (b) is determined to be 1 to 10 parts by weight. Examples to be used as the component (b) are petroleum type mineral oils, synthetic oils, and cylinder oils.

(5) The silicone oil, which is the component (c) of the above-mentioned (1), is for fortifying the lubricating property at a high temperature. The component is determined to be silicone oil having a dynamic viscosity of 150 $mm^2/s$ or higher at 40° C. in an amount of 15 parts by weight or less. This component is also for keeping the lubricating property at a temperature as high as about 250° C. to 400° C. by adhering to the die surface. Since it is expected to keep the lubricating property in a higher temperature range than that of the highly viscous mineral oil of the component (b), the dynamic viscosity at 40° C. is preferably higher than that of the component (b), that is 150 $mm^2/s$ or higher.

With respect to the "silicone oil" of the component (c) of the above-mentioned (1), in the case where a cast product is not coated, any commercialized silicone oils including dimethyl silicone may be used. However, in the case of coating, it sometimes becomes difficult to form a coating with good adhesion. Therefore dimethyl silicone is undesirable in some cases, although its acceptability depends on the coating amount to the die casting product. In such a case, it is preferable to select alkyl silicone oil having alkyl-aralkyl or a long chain alkyl group longer than dimethyl function.

The amount of the component (c) of the above-mentioned (1) is determined to be "15 parts by weight or less". The reason is that silicon itself or silicon decomposition products are deposited on the die surface to cause a bad effect on the shape of the cast product if it exceeds 15 parts by weight. In the case where the die is used at a low to middle temperature (lower than 250° C.), silicon oil is not necessary to formulate since additives having the lubricating property are added as the component (d). In the case of the use at a high temperature (250° C. or higher) silicone oil, which is hard to be decomposed, should be formulated. However, in terms of the cost, the addition amount of the silicone oil is preferable to be low. The additive having the lubricating property, which are the component (d), may include, for example, an organic molybdenum.

(6) The additives having the lubricating property, which are the component (d) of the above (1), fortifies the lubricating property at a low to middle temperature. The additives may include, for examples, animal and plant fats such as rapeseed oil, soybean oil, coconut oil, palm oil, beef tallows oil, and lard; esters of monohydric alcohol or polyhydric alcohols with higher fatty acids such as fatty acid esters, coconut oil fatty acids, oleic acid, stearic acid, lauric acid, palmitic acid, and beef tallow fatty acids; organic molybdenum; oil-soluble soaps and oily waxes. The organic molybdenum is preferably, for example, MoDDC and MoDTC, but MoDDP and MoDTP are not preferable due to a possibility to cause reaction of aluminum and a phosphorus component. Examples of the oil-soluble soaps may include sulfonated salts, phinate salts, and salicylate salts of Ca or Mg. Organic acid metal salts can be exemplified, although the solubility is not satisfactory.

(7) For the invention, the combinations of the above-mentioned solvent having the described viscosity and flash point with mineral oils and/or the synthetic oils may be four kinds; a solvent alone, a solvent in combination with mineral oils, a solvent in combination with a synthetic oils, and a solvent in combination with a mineral oil and a synthetic oil. The solvent is not limited to one kind and two or more kinds of solvents may be used in combination. But, petroleum type solvents are preferable from a viewpoint of health of workers. The above-mentioned mineral oils may include machine oils, turbine oils, spindle oils and cylinder oils. Synthetic esters can also be used.

(8) In the invention, the flash point of the release agent is required to be from 70 to 170° C. Herein the lower limit value of 70° C. is for lowering the risk of a fire. This value is higher than the flash point of kerosene (about 40° C.), which was used in the old type release agents. Therefore, this enables to apply the oil type release agent to the automatic die casting process. The upper limit value of the flash point is determined to be 170° C. because of the following reasons. That is, if mineral oils or synthetic oils with a high viscosity (that is high flash point) are used, the oil film adhering to the die cannot be dried out resulting in dripping off from the die surface. Due to the dripped-off oil portion, the adhesion efficiency on the die surface becomes worsen and ambient environments become worsen. Accordingly, to avoid the problem, the flash point should be 170° C. or lower.

(9) The dynamic viscosity of the release agent at 40° C. has to be 2 to 30 $mm^2/s$. The reasons are as follows. If the dynamic viscosity is lower than 2 $mm^2/s$, pump wear increases at the time of applying the release agent. If it exceeds 30 $mm^2/s$, pumping up of the agent at the time of application of the release agent becomes difficult resulting in instable. If the control becomes instable, application of 20 cc or less becomes difficult. If the control becomes difficult, spray amount of the release agent fluctuates every shot and accordingly stable castability cannot be maintained. The dynamic viscosity is more preferably in the range of 2 to 20 $mm^2/s$ for more stable spray amount and more finer mist formation.

(10) The oil type release agent of the first invention has following merits against conventional water soluble type release agents:

1) The oil type release agent does not cause quenching reaction;

2) The agent has a high heat resistance and anti-soldering property;

3) The agent prolongs the die life and contributes to no waste fluid disposal;

4) The adhesion efficiency can be kept at an appropriate oil film thickness by the flash point adjustment from 70 to 170° C. level. Thus the high temperature lubricating property can be ensured;

5) It makes possible to optimize spraying characteristics and minimize scattering of the agent in air by setting the dynamic viscosity at 40° C. within a proper range from 2 to 30 $mm^2/s$;

6) It reduces die casting problems such as galling, and soldering by forming and uniform oil film on the die surface even the spray amount is small and the oil film is thin; and 7) It also reduces a blister problem at the time of thermal treatment process for the die casting product because of thin oil film.

(11) In the first invention, the spray amount of the release agent to the die is desirably 20 cc or less, more preferably 1 cc or less, and more preferably 0.5 cc or less for every shot on the basis of the neat liquid. The reason for this is because if the spray amount exceeds 20 cc, it becomes difficult to carry out casting with no waste fluid generation, and the amount of the gas entrained in a cast product is high level resulting in high level of the porosity. As described, since the spray amount is 20 cc or less, waste liquid-free casting can be achieved. Also for the same reason, the gas entrainment in a cast product is decreased. Further, since neither powder nor wax is used, too much adhesion and solid accumulation on the die casting machine are prevented.

(12) The reason of the above-mentioned soldering is supposed to occur with too thin oil film between the cast product and the die surface. Particularly, the soldering occurs frequently in the projection parts just like core pins. Generally, it is said that the core pins are in portions where sprayed mist is less led and the oil film there becomes thinner than other portions. Additionally, if the continuous casting is started using the oil type release agent, the die gradually becomes hot because no external cooling function is with the agent. The adhesion amount of the release agent on the die surface decreases with the temperature increase, oil film is thermally deteriorates and thus the oil film becomes thinner. To solve such a problem, there are methods in which a wettability improving additive is added to increase the adhesion amount for fortifying the oil film or an antioxidant is added to retard the thermal deterioration of the oil film.

Accordingly, in the first invention, it is preferable to add the wettability improving additive or antioxidants besides the respective components (a) to (d) of the above-mentioned (1). As the wettability-improving additive, for example, 0.1 to 3 parts by weight of acrylic copolymers or acryl-modified polysiloxanes with the flash point of 100° C. or lower may be added. In the above-mentioned range on the addition, the wettability improving additive has an adhesive effect although it is an agent for improving the wettability. Herein, if the wettability improving additive is added, the wettability of the release agent to the metal surface is improved resulting in the increase of adhesion amount on the metal surface. Especially, if the metal surface is quite hot, the phenomenon (Leidenfrost phenomenon) occurs. Because of this, that light-weight components of the release agent are bumped abruptly and oil mist droplets are kept from wetting the metal surface. Thus the film formation on the metal surface is inhibited. Since the wettability is improved due to the wettability improving additive, such a phenomenon is suppressed and the oil film is made thicker.

(13) It is also preferable to add the antioxidants, 0.2 to 2 parts by weight in total of one or more kinds of antioxidants which are selected from a group consisting of amine type, phenol type and cresol type antioxidants. This component is added for preventing or retarding the oxidation deterioration at the time of high temperature operation, keeping the thickness of the oil film, ensuring the lubricating function, and inhibiting a soldering occurrence.

Examples of the above-mentioned amine type antioxidants are monoalkyldiphenylamine types such as monononyldiphenylamine; dialkyldiphenylamine types such as 4,4'-dibutylphenlamine, 4,4'-dipentyldiphenylamine, 4,4'-dihexyldiphenylamine, 4,4'-diheptyldiphenylamine, 4,4'-dioctyldiphenylamine, and 4,4'-dinonyldiphenylamine; polyalkyldiphenylamines such as tetrabutyldiphenylamine, tetrahexyldiphenylamine, tetraoctyldiphenylamine, and tetranonyldiphenylamine; α-naphthylamine, phenyl-α-naphthylamine, butylphenyl-α-naphthylamine, pentylphenyl-α-naphthylamine, hexylphenyl-α-naphthylamine, heptylphenyl-α-naphthylamine, and octylphenyl-α-naphthylamine.

Examples of the above-mentioned phenyl type antioxidants are 2,6-di-tert-butyl-4-methylphenol, 2,6-di-tert-butyl-4-ethylphenol, 4,4-methylenebis(2,6-di-tert-butylphenol), 2,2-methylenebis(4-ethyl-6-butylphenol), high molecular weight mono-cyclic phenols, polycyclic tert-butylphenols, BHT (butylated hydroxy toluene), BHA (butylated hydroxy anisole). Examples of cresol type antioxidants are di-tert-butyl-p-cresol and 2,6-di-tert-butyl-dimethylamino-p-cresol. Among the above-mentioned antioxidants, mixtures of BHT with alkyldiphenylamines are preferable.

In the invention, antirust agents, surfactants, preservers, defoaming agents, and other additives (e.g., extreme pressure additives, viscosity index improvers, cleaning dispersants, coloring agents, and fragrant agents) may be added properly.

(14) In the invention, with respect to the above-mentioned oil type release agent containing the respective components (a) to (d), after one to three optional components among these components are previously mixed to obtain a mixture and then the remaining components may be mixed with the mixture to obtain the release agent. Specifically, the components (b), (c), and (d) are previously mixed to obtain a mixture 1 and successively a user may mix the component (a) with the mixture 1 to form the release agent. Also the components (a) and (b) are mixed to obtain a mixture 2 and later a user may mix a mixture 3 of the components (c) and (d) with the mixture 2 to obtain the release agent.

Also, among the five components including the respective components (a), (b), (c), and (d) and additionally a wettability improving additive or an antioxidant (defined as a component [e]), one to four optional components are previously mixed to obtain a mixture. And then the remaining components may be mixed with the previous mixture to obtain the release agent.

(15) A low viscosity oil type release agent has many advantageous points. However it also has disadvantageous points due to a small amount spray of water free type agent. The die surface is not cooled externally. The die temperature fluctuation is slight in one cycle of die casting. And then the steady state is kept at a high temperature. Herein, if the temperature is about 350° C. or lower, there is no problem at all and the advantageous points of the low viscosity oil type release agent can be utilized as they are. However, if the temperature is higher than that, soldering sometimes occurs between the cast product and the die, and it becomes difficult to carry out continuous casting. As another inferior point, it is sometimes required to reform a die system for reinforcing internal cooling for the oil type release agent where an oil type release agent is to be used for an already existing casting machine which is operated mainly in an external cooling manner by spraying a large amount of the water soluble type release agent to a die. Further, for reasons relevant to the die structure or product shape, inner cooling is sometimes impossible. Therefore, it is desired to develop an oil type release agent provided with a high temperature lubricating property and capable of dealing with the Leidenfrost problem without reforming the machine.

A setting method of the solvent mixing ratio of the invention (the second invention) is carried out based on the above-mentioned background. That is, the second invention is the method for setting a mixing ratio of the above-mentioned solvent to avoid Leidenfrost phenomenon at the time of die casting using the oil type release agent of the first invention. Two or more kinds of solvents are used for the above-mentioned solvent. The invention involves the first, second, third and fourth steps. The first step is to interpolate the expected highest use temperature (S) in the following equations (1) and (2) for calculating the flash point (F) of a release agent. The second step is to investigate the flash point for three or more different release agents having different concentrations of the respective solvents. The third step is to make a graph of the correlation of the % value by weight of the solvent in each release agent. The fourth step is to calculate the % value by weight of the solvent in the release agent to be formulated from the graph and the flash point calculated from the equations (1) and (2).

$$S+80=L \quad (1)$$

$$L=4.4\times F+36 \quad (2)$$

where S denotes the highest temperature for use of a release agent; L denotes Leidenfrost phenomenon temperature; and F denotes the flash point of the release agent.

The setting method of the solvent mixing ratio of the third invention is the method for setting the mixing ratio of the above-mentioned solvents with the above-mentioned mineral oil and/or synthetic oil to avoid Leidenfrost phenomenon at the time of die casting using the oil type release agent of the first invention. The invention involves the first, second, third and fourth steps. The first step is to interpolate the expected highest use temperature (S) in the above-mentioned equations (1) and (2) for calculating the flash point (F) of a release agent. The second step is to investigate the flash point for three or more different release agents having different concentrations of the respective solvents, mineral oils and/or synthetic oils. The third step is to make a graph of the correlation of the % value by weight of the solvent in each release agent. The fourth step is to calculate the % value by weight of the solvent in the release agent from the graph and the flash point calculated from the equations (1) and (2).

(16) Next, the Leidenfrost phenomenon of the above-mentioned (15) is described below.

When the oil type release agent is brought into contact with a hot die, lightweight hydrocarbon components in the agent bump abruptly. Those hydrocarbon components make a rising gas current and other parts of the hydrocarbon components are in the air as oil droplets. Because of the rising gas current, oil droplets float up from the die surface to worsen the contact of the droplets with the die surface. As a result, the heat is not transmitted to the oil droplets to make the evaporation speed slow down. Since active components of the oil droplets are inhibited from the adhesion on the die, the adhesion amount is decreased to worsen the releasing property. This phenomenon is called the Leidenfrost phenomenon and it has been known well in the case of water soluble type release agents. This phenomenon occurs around 150 to 200° C. in the case of water soluble type release agents, while the phenomenon occurs at 350° C. or higher in the case of the oil type release agent invented. This was found based on the investigations carried out for the invention.

Figure 7:
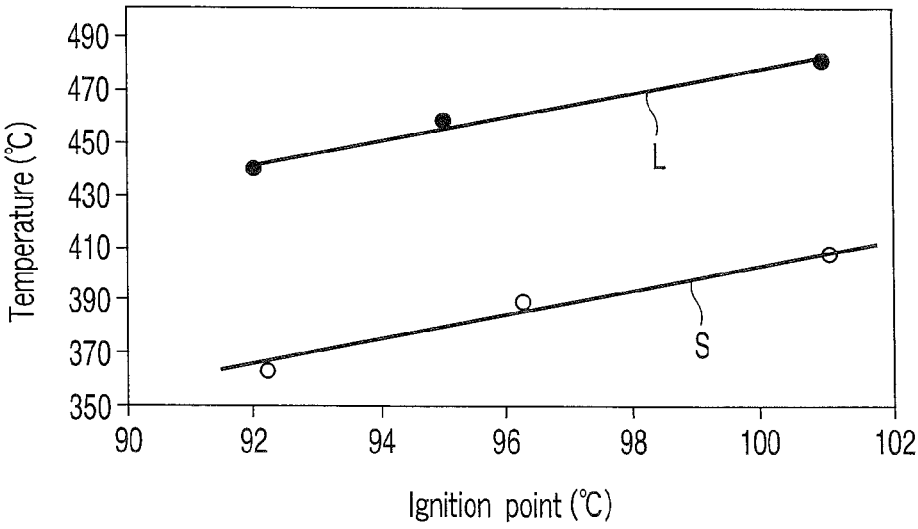
FIG. 7 is a characteristic graph showing the correlation of the flash points of various kinds of release agents with Leidenfrost temperature and maximum use temperature.

The present inventors have investigated the temperature at which the Leidenfrost phenomenon occurs in an experimental scale. In addition, the inventors studied the highest use temperature in an actual die casting machine and the flash point of release agent. The results are shown in FIG. 7. As shown in FIG. 7, when the flash point rises, the Leidenfrost phenomenon temperature goes up and the highest useable temperature becomes higher in the actual machine. In this case, the temperature, at which the Leidenfrost phenomenon occurs, is defined as a point at which the evaporation speed becomes the slowest. But the evaporation speed is found to be retarded when the temperature is still lower before that point. That is, it can be said that at the temperature lower than the Leidenfrost phenomenon temperature by about 80° C., the release agent reaches its practical use limit. From FIG. 7, the following correlation can be assumed:

$$S+80=L \quad (1)$$

$$L=4.4\times F+36 \quad (2)$$

where S denotes the highest temperature for use of the oil type release agent (° C.); L denotes the Leidenfrost phenomenon temperature (° C.); and F denotes the flash point (° C.).

As assumed from FIG. 7, if the Leidenfrost phenomenon point of the release agent is increased, the highest practical use temperature can be raised. Herein, there are two methods to increase the highest practical use temperature. A former method is to increase the flash point of the agent to confirm the practical application by using an actual machine. The latter method is to increase the Leidenfrost phenomenon temperature by increasing the flash point. However, a large scale experiment is required to confirm the practical applicability by using the actual machine. Since the method for measuring the Leidenfrost phenomenon temperature in the laboratory scale is easier, the latter method is employed. However, if the flash point is increased and the spray amount is increased too much, the fume becomes dense at the time of spray and therefore, it is required to carry out the experiments carefully.

Figure 8:
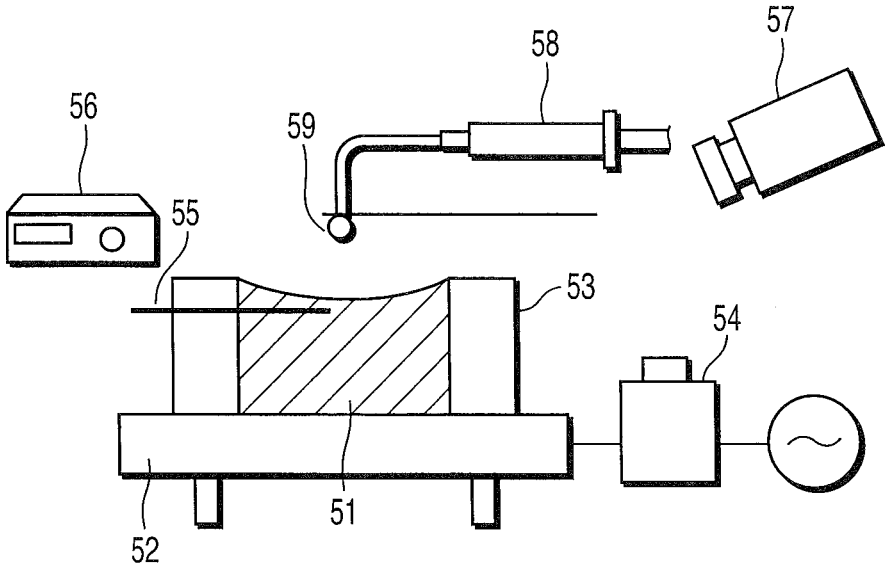
FIG. 8 is an explanatory drawing of an apparatus for measuring the Leidenfrost temperature.

Next, the measurement method of the Leidenfrost phenomenon temperature will be explained with reference to FIG. 8. For the measurement, the apparatus of FIG. 1 is employed as described in Takeo TAKASHIMA, Hiroshi SHIOTA, "Study on Evaporation of Oil-in-Water type Emulsion Droplets on Heated Face", Transactions (B edition) of The Japan Society of Mechanical Engineers, Vol. 70, No. 700 (2004-12) No 03-1248.

At first, a saucer 51 made of brass is put on a heater 52. The saucer has a cylindrical and saucer-like structure with a diameter of 60 mm, a height of 30 mm, and a curvature radius R of 200 in the upper face, and a depth of 4 mm in the center. The saucer 51 is covered with an insulator 53 and a transformer 54 is connected to the heater 52. A thermocouple 55 is embedded under the center in 2 mm depth of the saucer 51 and connected with a temperature recorder 56. Further, a video camera 57 is installed for photographing the bumping state. Also, a release agent is put in a syringe 58 made of polyethylene and equipped with a thin tube. The tip end of the thin tube is set above the center of the saucer at 40 mm height. In this case, the diameter of a droplet 59 is about 2.7 mm. When the temperature of the saucer 51 reaches a prescribed temperature, one droplet 59 at a room temperature is dripped. And then the evaporation time is measured by a stop watch. Also, the state of the droplet is observed by the video camera 57. The above-mentioned observation is carried out at every 10° C. and the graph of the correlation between the temperature and the evaporation time is produced. The temperature, at which the evaporation time is the longest, is defined as Leidenfrost phenomenon temperature.

(17) The above-mentioned release agent will be described more in detail. The oil type release agent is free from water, powder or emulsifier. It is understood that if no water is contained, the die is less cooled and the thermal fatigue is minimized and therefore the die life is remarkably improved. For example, according to a small die casting product obtained by using an actual die casting machine, repair and maintenance of the die are required every 20000 times shot in the case of a water-soluble agent. However no repair of the die is required even after 320000 times shot in the case of the oil type agent. And it is thus proved the life is at least 16 times as long. The economic effect is equivalent to the cost down of several million yen in the case of small scale of 350 ton machine. Further, since no water is used and small amount blowing is made possible, no waste fluid is discharged and the waste liquid treatment cost is also remarkably saved. Further, because a very small amount of spray, the smoke or fume is extremely decreased and the work environments are remarkably improved.

Further, since the oil type release agent of the invention contains no emulsifier, which is indispensably employed for all water-soluble release agents. The oil type release agent is advantageous in the waste liquid treatment. The oil type release agent is also suitable for avoiding endocrine disrupting substance problems. Further, since the release agent of the invention contains no powder, the agent is also advantageous in suppression of the staining of apparatus, prevention of quality alteration of the release agent due to precipitation during storage, and retention of surface luster without damages on the surface of a cast product with a powder.

Figure 1B:
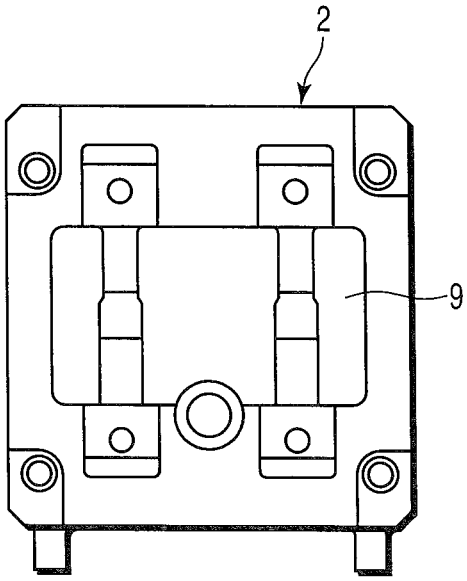
FIG. 1B is a front view of a fixed die employed in Examples of the invention.

(18) A casting method of the invention (the fourth invention) is for die casting by using the oil type release agent for the die casting of the first invention and the release agent spray unit. According to the invention, die casting is made possible by using the oil type release agent. FIG. 1A shows the front view of a movable die to be used in the invention and FIG. 1B shows the front view of a fixed die part of the die to be used in the invention. The above-mentioned die is composed of the movable die 1 and the fixed die 2 and the movable die 1 is provided with an upper slide 3, a lower slide 4, and a movable core 5. The reference numeral 6 in the figure denotes a guide pins; the reference numeral 7 denotes surface pins; the reference numeral 8 denotes ejector pins for runners; and the reference numeral 9 denotes a fixed core.

Figure 2:
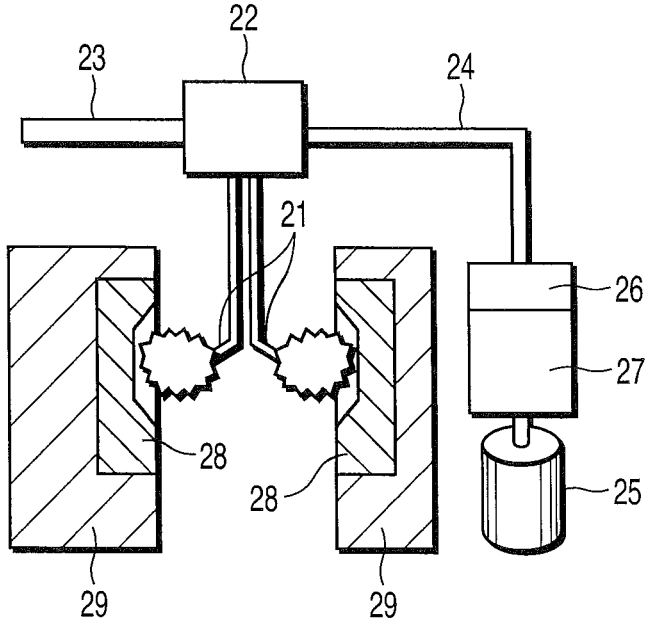
FIG. 2 is a schematic explanatory drawing of a spray system of the invention.

(19) A spraying system of the invention (the fifth invention) is a device for applying the oil type release agent for the die. This system comprises a spray unit provided with plural nozzle tubes for spraying the release agent to the die and a pressurized delivery unit to send the release agent to the spray unit which is used at a low pressure to apply a small amount of the release agent to the die. The spray system is provided with a spray unit 22 having a plurality of spray nozzles 21 as shown in FIG. 2. A tube 23 for air introduction into which air is introduced and a tube 24 for release agent introduction into which the oil type release agent for the die casting is introduced are connected with the spray unit 22. A tank 25 for storing the oil type release agent is connected to the tube 24 for release agent introduction via a pressure reducing valve 26 for pressure sending the release agent and a pump 27 for pumping the release agent. The pressurized delivery unit comprises the tank 25, the reducing pressure valve 26 for the release agent, the pump 27 for pumping the release agent, and a release agent pressure sending hose, which is not illustrated here. The reference numeral 29 in the drawing shows the die having a cavity part 28.

(20) In the case where the above-mentioned oil type release agent is employed by the already existing spray system for a water soluble type release agent, that is, a unit type spray system having a large number of nozzles, there has been the problems mentioned below:

1) Since the oil type release agent has a higher viscosity than the water soluble type release agent, the spraying amount per every nozzle is not well balanced; and 2) Fine adjustment of the spraying amount is difficult.

Thus, in the case where the oil type release agent is automatically applied to carry out die casting by using the already existing spray system for a water soluble type release agent without reforming the system, problems such as galling, flow line, metal wave, and much gas remaining in a product (porosit) are frequently caused. To deal with these problems, it is required to evenly apply the release agent to the die.

In the spray unit of the invention, spray unit comprises a spray unit main body, tubes for air introduction and tubes for release agent introduction. Each of air tubes and agent tubes is connected with the spray unit main body as a set of tubes, respectively. As a pair of multiple sets of tubes are arranged face to face at two or more points, so that the release agent from the spray nozzles can be sprayed evenly to the die.

Figure 3:
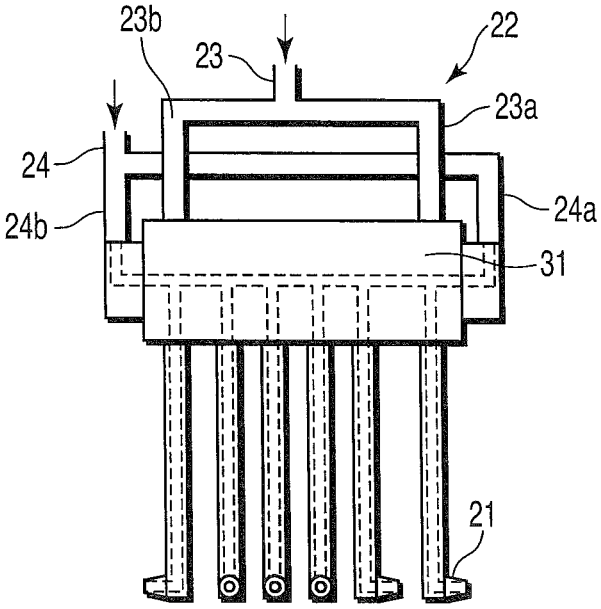
FIG. 3 is an explanatory drawing of the spray unit, one of constituents of the spray system drawn in FIG. 2.

Spray unit 22 has a structure shown in FIG. 3. The reference numeral 31 in the drawing denotes a spray unit main body. Tubes 23*a* and 23*b* for air introduction branched from the tube 23 for air introduction are connected to both ends of the spray unit main body 31. Tubes 24*a*, and 24*b* for release agent introduction branched from the tube 24 for release agent introduction are connected to both sides of the spray unit main body 31. Accordingly, the set of the branched tubes 23*a* and 24*a* are arranged on the side of tubes 23*b* and 24*b* as a pair. In FIG. 3, the sets of tubes for air introduction and for release agent introduction are arranged on the opposite to each other at two points. However the pair of tubes may be arranged on the opposite to each other at three or more points.

The reason is described below for the arrangement of the pair of tubes on the opposite to each other at two or more points is as follows.

(21) The spray unit for the water-soluble release agent has a large number of spray nozzles having release agent application nozzles. Conventionally, there is only one set of a supply port (a tube for release agent introduction) and an air supply port (a tube for air introduction). In the case where the spray unit is employed for applying the oil type release agent without any modification, the release agent is applied more than necessity from the spray nozzle due to near position to the set of the supply port for the oil type release agent and air supply port. This is because a small amount of the oil type release agent is used and the viscosity of the oil type release agent is higher than that of water soluble type release agent. On the other hand, the spray amount is less than necessity from the spray nozzles which are located at a remote portion from the introduction tubes and thus it is made impossible to evenly apply the oil type release agent to the die. Accordingly, a pair of the tubes sets for release agent introduction and for air introduction are arranged face to face at two or more points, so that pressure is applied evenly by the respective spray nozzles, and the oil type release agent and air are supplied evenly to the nozzles. Consequently, it is made possible to evenly apply a small amount of the oil type release agent for the die surface.

In the spray system of the invention, the pressurizing delivery unit may comprise a tank for storing the oil type release and a delivery hose for connecting the tank. The top level of the agent face in the tank is set between the upper limit position at the time when the spray nozzle is in waiting mode and the lower limit position at the time when the release agent is sprayed.

Figure 4:
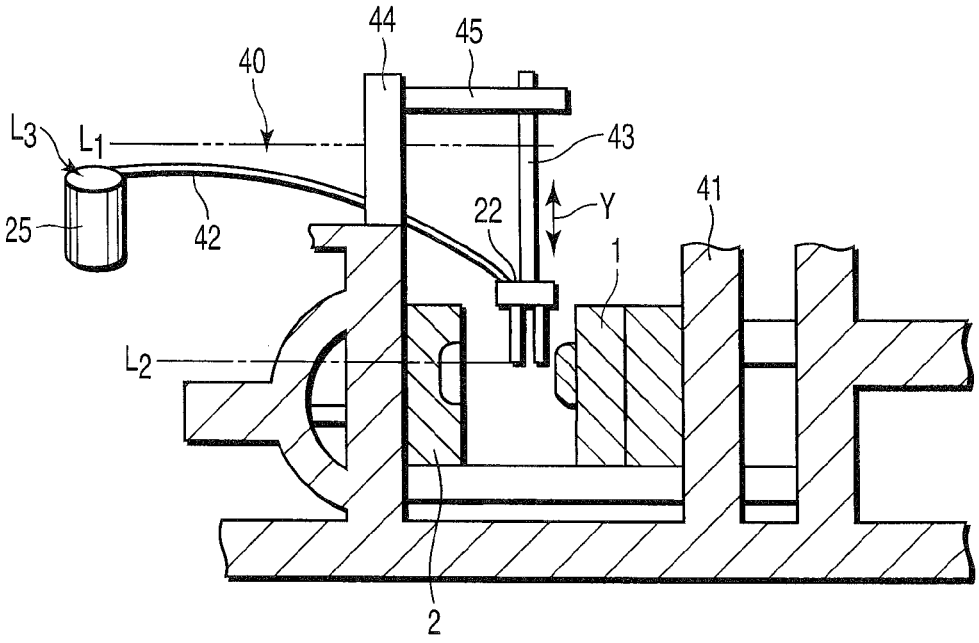
FIG. 4 is an explanatory drawing of a pressurized delivery unit, one of constituents of the spray system drawn in FIG. 2.

(22) The pressurizing delivery unit 40 has a structure as shown in FIG. 4. The reference numeral 41 in FIG. 4 shows the die casting machine. The movable die 1 and the fixed die 2 shown in FIG. 1 are arranged at a distance from each other in the die casting machine 41. The tank 25 storing the oil type release agent is connected to the spray unit 22 via a release agent pressure sending hose 42. Although not illustrated, a pressure reducing valve and a pump for pumping up the release agent show in FIG. 3 are installed in the tank 25. The spray unit 22 is made movable up and down by a supporting pole 43 which is movable up and down (in the direction shown as the arrow Y). The supporting pole 43 is guided by s supporting pole 44 mounted on a part of the die casting machine 41 and a transverse bar 45 joined to the supporting pole 44.

Following are reasons why the top level of the agent face in the tank is set in the above-mentioned manner. That is, to apply a small amount of the oil type release agent, it is necessary to send the agent at a low pressure by the pump to the spray unit and the sending pressure of the oil type release agent is as extremely low as 0.02 to 0.05 MPa. Therefore, if a very small amount of air, which is mixed in the release agent, is sent together with the agent by pump, a rather large air layer, so-called air spot, is formed at the highest point in the tube. This air spot interrupts the flow of the release agent to lose the stability of the spraying amount. As a result, in a mass production of die casting products, the repeatability precision of the spray amount control of the release agent is worsened and the quality of die casting products is affected adversely.

On the other hand, it is found that this spray control problem can be solved by setting as mentioned before. The top level of the agent face in the tank should be set between the upper limit position (the position is higher than the tank) $L_1$ at the time when the spray nozzles are in waiting mode and the lower limit position $L_2$ at the time when the release agent is sprayed (reference to FIG. 4). That is, during the time when the spray nozzles are set at the lower face position in the waiting mode, the pressure is increased corresponding to the liquid pressure (the height of the release agent) in relation to the tank position, the flow rate of the release agent is increased accordingly, and the accumulated air also becomes easy to flow to decrease the air spots. However, if the tip end position of the nozzles is set to be further lower than the above-mentioned position, the air flows out faster, but a large quantity of the release agent is also discharged. It causes a difficulty in applying a small amount of the agent. Accordingly, it is required to set the lower limit position. On the other hand, the pressure is low during the time of the waiting mode of the spray nozzles at the upper level position, so that the flow of the release agent is decreased and air hardly flows out of the tip of the nozzles. Further, when the nozzle is at higher than that, the liquid pressure of the release agent is lowered, finally the release agent tends to go back to the tank, and air is sometimes sucked from the tip of the nozzles. Because of that, the upper level position of the spray nozzles is also limited. The position of the tank for the release agent is set between the lower limit and the upper limit, so that small amount spray can be achieved and the air spot problem can be solved simultaneously. Further, it is made possible to supply the release agent to the spray unit by a minimum delivery pressure of the necessity. Owing to this effect, with respect to the spray amount, application in an amount as low as 0.1 to 0.2 cc per one nozzle is made possible. And even and small amount spray to the die surface can be carried out.

Hereinafter, Examples of the invention will be described. However, it is not intended that the invention be limited to the illustrated Examples.

(I) EXAMPLES 1 TO 5 AND COMPARATIVE EXAMPLES 1 TO 3

(A) Components and Results of Measurement Tests

The following Table 1 shows the components of Examples 1, 2, 3, 4, and 5, physical values, results of the adhesion test, and results of a friction test. Also, the following Table 1 shows Comparative Examples 1 to 3 the components of water soluble type release agents produced by the applicant of the invention: that is, a water-soluble pigment release agent (trade name: Lubrolene A-704), a water soluble type release agent (trade name: Lubrolene A-201), and a water soluble type release agent (trade name: Lubrolene A-1609), physical values, results of the adhesion test, and results of the friction test.

(B) Production Method

After mixing a high viscosity mineral oil, a silicone oil, a rapeseed oil and an organic molybdenum at ratios shown on the basis of % by weight in Table 1, the mixture was heated to 40° C. and stirred for 10 minutes. The mixture was further mixed with a solvent in the amount on the basis of % by weight shown in Table 1 and again mixed for 10 minutes to produce the oil type release agent.

TABLE 1

| | Examples | | | | | Comparative Examples | | |
|---|---|---|---|---|---|---|---|---|
| | 1 | 2 | 3 | 4 | 5 | 1* | 2* | 3* |
| Components (% by weight) | | | | | | | | |
| Water | 0 | 0 | 0 | 0 | 0 | 99 | 99 | 99 |
| Solvent | 97.8 | 96.2 | 88 | 86 | 80 | — | — | — |
| High viscosity mineral oil | 1 | 1.7 | 5 | 6 | 6 | — | 0.05 | 0.02 |
| Silicone oil | 1 | 1.7 | 5 | 6 | 12 | 0.05 | — | 0.03 |
| Rapeseed oil | 0.1 | 0.2 | 1 | 1 | 1 | — | — | — |
| Organic molybdenum | 0.1 | 0.2 | 1 | 1 | 1 | — | — | — |
| Physical values | | | | | | | | |
| Flash point (° C.) | 89 | 89 | 92 | 92 | 95 | Impossible to measure | Impossible to measure | Impossible to measure |
| Dynamic viscosity (40° C., $mm^2/s$) | 2 | 3 | 5 | 6 | 11 | 1 | 1 | 1 |
| Adhesion amount (300° C., mg) | 3.3 | 4.4 | 6.7 | 8.9 | 19.5 | 0.7 | 0.7 | 1.3 |
| Adhesion efficiency of active components (%) | 59.5 | 46 | 22.2 | 25.2 | 38.7 | 3.3 | 2.3 | 4.1 |
| Friction force at 300° C. (kgf) | 3.7 | 3.2 | 3.9 | 3.4 | 3.4 | 7.0 | 6.2 | 10.1 |
| Friction force at 350° C. (kgf) | 7.6 | 5 | 3.9 | 3.5 | 4.4 | 10.1 | Occurrence of welding | Occurrence of welding |
| Capability for actual system | | | | | | | | |
| Adhesion property (300° C.) | Ordinary | Good | Excellent | Excellent | Excellent | Good | Ordinary | Inferior |
| Friction force (300° C.) | Good | Excellent | Excellent | Excellent | Excellent | Ordinary | Ordinary | Ordinary |
| Friction force (350° C.) | Good | Excellent | Excellent | Excellent | Excellent | Ordinary | Inferior | Inferior |
| Comprehensive evaluation | Good | Excellent | Excellent | Excellent | Excellent | Ordinary | Inferior | Inferior |

*Water-soluble release agent and the balance, 0.05% by weight, was a wax, an emulsifier or the like.

In Table 1,

Solvent: trade name: Shellsol™, manufactured by—Shell Kagaku K.K.

High viscosity mineral oil: trade name: Bright stock, manufactured by Japan Energy Corporation, Fats: Rapeseed oil manufactured by Meito Yushi Co., Ltd.

Silicone: trade name: Release Agent TN manufactured by Asahikasei Wacker Silicone Co., Ltd.

Organic molybdenum: trade name: Adeka 165, manufactured by Asahi Denka Kogyo (C) Measurement Method of Flash Point The flash point of each specimen was measured by Pensky-Martin method according to JIS-K-2265

(D) Measurement Method of Dynamic Viscosity

The dynamic viscosity at 40° C. was measured according to JIS-K-2283.

(E) Measurement Method of Adhesion Amount (E-1) Preparation

As a specimen, an iron plate (SPCC, 100 mm×100 mm×1 mm thickness) was baked at 200° C. for 30 minutes in an oven, cooled overnight in a desiccator, and the plate weight was measured to 0.1 mg order.

(E-2) Spray of the Oil Type Release Agent

Figure 5:
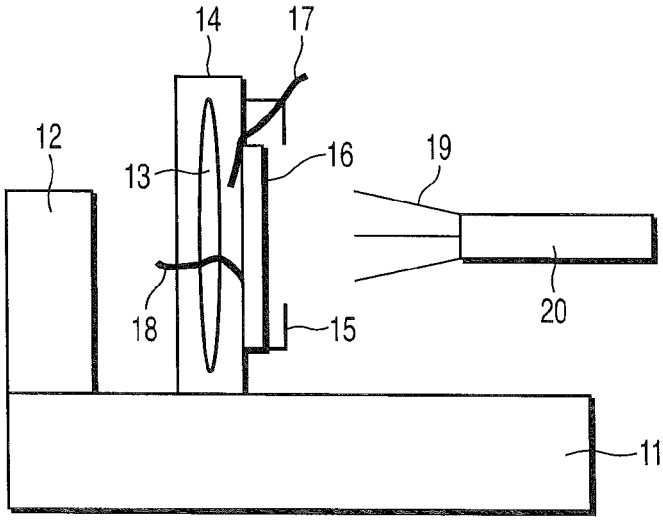
FIG. 5 is a schematic explanatory drawing of an adhesion tester to be used for measuring the adhesion amount of releasing agent of the invention.

The operation of the adhesion tester shown in FIG. 5 was as follows.

At first, an electric power source temperature adjustment apparatus 12 was set at a prescribed temperature and a stand 14 for holding a specimen was heated by a heater 13. Herein, when the first thermocouple 17 reached the set temperature, the iron plate 16 as a specimen was put on a metal fitting 15 for supporting a specimen and the second thermocouple 18 was brought into firm contact with the iron plate 16. After that, when the temperature of the iron plate 16 reached the prescribed temperature, a prescribed amount of each release agent 19 was automatically sprayed to the iron plate 16 by the spray 20. Then, the iron plate 16 was taken out and stood vertically in air for a fixed time, to allow an oil dripping off from the iron plate 16.

(E-3) Measurement Method of Adhesion Amount

After keeping the iron plate 16 with coated ingredients in an oven at a prescribed temperature for a prescribed period, the plate was taken out. The plate was cooled by air, and further cooled in the desiccator for a prescribed period. After that, the weight of the iron plate 16 bearing the coated ingredients was measured up to 0.1 mg order. And the adhesion amount was calculated from the weight change of the iron plate considering a blank test result.

(E-4) Test Condition

Tester: Adhesion amount tester (manufactured by Yamaguchi Giken Co., Ltd.)

Measurement conditions: as described in the following Table 2.

TABLE 2

| | Oil type | Water-soluable |
|---|---|---|
| Release agent solution | Undiluted solution | Solution diluted by 80 times |
| Spraying amount (cc) | 0.3 | 10 |
| Air pressure (MPa) | 0.3 | 0.3 |
| Liquid pressure (MPa) | 0.003 | 0.2 |
| Testing temperature (° C.) | 300 | 300 |
| Drying after testing | At 200° C. for 30 minute | None |

(F) Measurement Method of Friction Force (F-1) Friction Testing Method

Figure 6A:
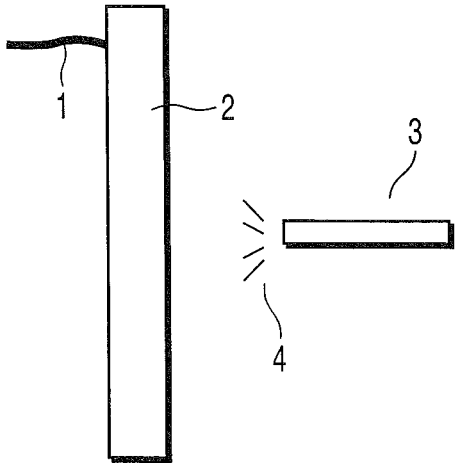
FIG. 6A is an explanatory drawing showing the state that a release agent is sprayed from a nozzle for measuring the friction force over a specimen.
Figure 6B:
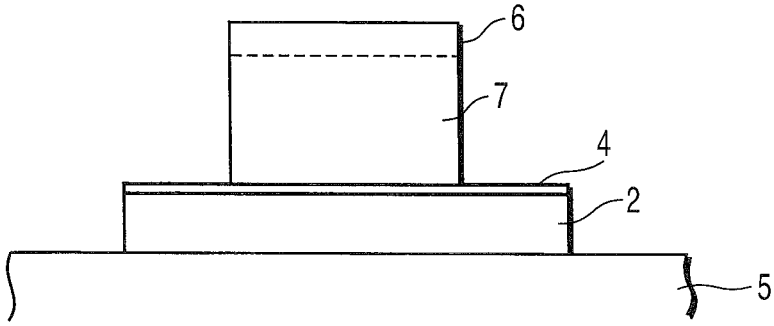
FIG. 6B is an explanatory drawing showing the state that a ring is put on a tester main body through a test stand.
Figure 6C:
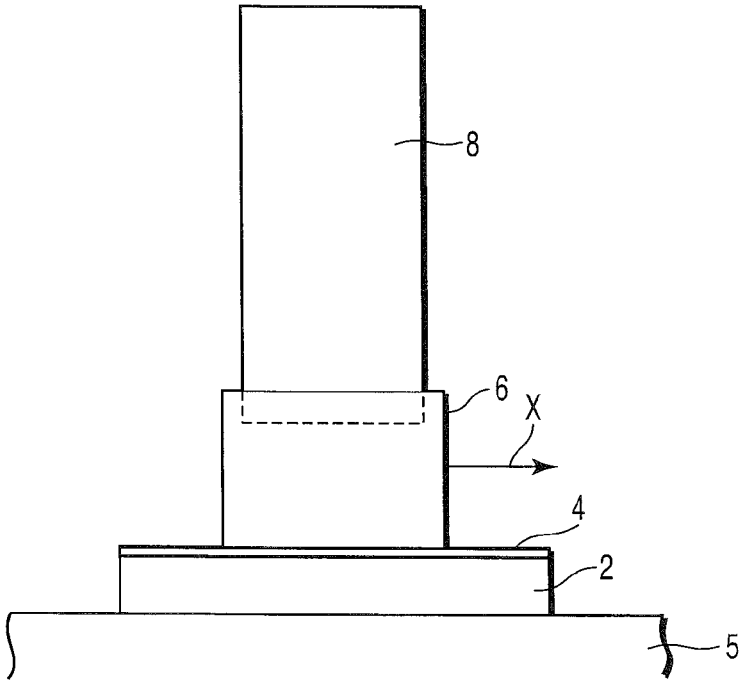
FIG. 6C is an explanatory drawing showing the state that the friction force is measured.

Reference to FIGS. 6A to 6C. At first, a friction testing stand 2 (SKD-61 model, 200 mm×200 mm×34 mm) having a thermocouple 1 attached to an automatic pulling tester (trade name: Lub Tester U) manufactured by MEC International Co., Ltd. was heated to a prescribed temperature by a commercially available heater. Next, as shown in FIG. 6A, the testing stand 2 was vertically stood and a release agent 4 was sprayed by a nozzle 3 under the conditions shown above in the adhesion test. Immediately after that, the testing stand 2 was horizontally put on the tester main body 5 and a ring 6 (made of S45C, inner diameter 75 mm, outer diameter 100 mm, and height 50 mm) manufactured by MEC International Co., Ltd. was put on the center (refer to FIG. 6B). Successively, 90 cc of aluminum molten metal 7 (ADC-12, at 670° C.), which was melted at a melting furnace for a ceramic art use, was poured into the ring 6. The molten metal was cooled for 40 seconds to be solidified. Further, an 8.8 kg weight 8 made of iron was immediately and calmly put on the solidified aluminum (ADC-12). Then, the ring 6 was pulled in the direction shown as the arrow X by a gear of the tester to measure the friction force (refer to FIG. 6C).

(F-2) Friction Force Measurement Conditions

The friction force measurement conditions were as shown in the following Table 3.

TABLE 3

| | |
|---|---|
| Load (total of aluminum and weight) | 10 Kg |
| Contact surface area (cross-sectional surface area of the ring) | 44.2 $cm^2$ |
| Pulling speed | 1 cm/sec |

(G) Collective Measurement Results (Oil Type Release Agent)

The test results were shown in Table 1 on flash point, dynamic viscosity, adhesion amount (300° C.), and friction force at 300° C. and 350° C. for the above-mentioned Examples and Comparative Examples.

It is confirmed by the tester manufacturer that the results have an excellent correlation with those carried out by actual die casting machines. 10 Kgf value in the tester corresponds to an allowable maximum level of the releasing property in the actual machines. A higher value than 10 Kgf in the tester suggests troubles such as soldering and galling in the actual machines.

According to the results of the functional comparative test, the oil type release agents of Examples 1 to 5 were found having higher adhesion amounts, lower friction forces and better releasing capability than the water soluble type release agents of Comparative Examples 1 to 3. Also, even at a high temperature of 350° C., at which the soldering occurred with water soluble type release agents, the oil type release agents were found having sufficiently excellent releasing capability.

(II) EXAMPLES 6 to 11 AND COMPARATIVE EXAMPLES 4 to 7

Hereinafter, release agents of Examples 6 to 11 containing a wettability improving additive will be described with reference to release agents of Comparative Examples 4 to 7.

(A) Components and Test Results

The following Table 4 shows components physical values, results of adhesion test, and results of friction force test of the oil type release agents of Examples 6, 7, 8, 9, 10, and 11. The following Table 5 shows physical values, components, results of adhesion test, and results of friction test for the oil type release agents of Comparative Examples 4, 5, and 6 and the water soluble type release agent (trade name: Lubrolene A-1609, manufactured by AOKI SCIENCE INSTITUTE Co., Ltd.) of Comparative Example 7.

TABLE 4

| | Examples | | | | | |
|---|---|---|---|---|---|---|
| | 6 | 7 | 8 | 9 | 10 | 11 |
| Components (% by weight) | | | | | | |
| Water | 0 | 0 | 0 | 0 | 0 | 0 |
| Solvent | 95.26 | 88 | 95.26 | — | 88.8 | 86 |
| Low viscosity mineral oil | — | — | — | 88 | — | — |
| High viscosity | 1.7 | 5 | 1.7 | 5 | 5 | 5 |

TABLE 4-continued

| | Examples | | | | | |
|---|---|---|---|---|---|---|
| | 6 | 7 | 8 | 9 | 10 | 11 |
| mineral oil | | | | | | |
| Silicone oil | 1.7 | 5 | 1.7 | 5 | 5 | 5 |
| Rapeseed oil | 0.17 | 0.5 | 0.17 | 0.5 | 0.5 | 0.5 |
| Organic molybdenum | 0.17 | 0.5 | 0.17 | 0.5 | 0.5 | 0.5 |
| Wettability improving agent (No. 1) *1 | 1 | 1 | — | 1 | 0.2 | 3 |
| Wettability improving agent (No. 2) *2 | — | — | 1 | — | — | — |
| Physical values | | | | | | |
| Flash point (° C.) | 89 | 92 | 89 | 159 | 92 | 93 |
| Dynamic viscosity (40° C., $mm^2/s$) | 3 | 5 | 3 | 24 | 4 | 6 |
| Adhesion amount (250° C., mg) | 4.5 | 11.5 | 4.9 | 6.9 | 10 | 12.1 |
| Adhesion amount (300° C., mg) | 4 | 11.9 | 4.3 | 5.6 | 9.3 | 15.6 |
| Friction force at 250° C. (kgf) | 1.3 | 1.4 | 1.3 | 1.2 | 1 | 2.6 |
| Friction force at 300° C. (kgf) | 2.1 | 3 | 2.4 | 2.2 | 1.8 | 2.3 |

*1: Trade name: EFKA-3236 modified polysiloxane, manufactured by Wilbur-Ellis Company
*2: Trade name: EFKA-3778 acrylic copolymer, manufactured by Wilbur-Ellis Company
Others components are the same as those shown in Table 1.

TABLE 5

| | Comparative Examples | | | |
|---|---|---|---|---|
| | 4 | 5 | 6 | 7 *3 |
| Components (% by weight) | | | | |
| Water | 0 | 0 | 0 | 99 |
| Solvent | 96.26 | 89 | — | — |
| Low viscosity mineral oil | — | — | 89 | — |
| High viscosity mineral oil | 1.7 | 5 | 5 | 0.02 |
| Silicone oil | 1.7 | 5 | 5 | 0.03 |
| Rapeseed oil | 0.17 | 0.5 | 0.5 | — |
| Organic molybdenum | 0.17 | 0.5 | 0.5 | — |
| Wettability improving agent (No. 1) *1 | 0 | 0 | 0 | — |
| Wettability improving agent (No. 2) *2 | 0 | 0 | 0 | — |
| Physical values | | | | |
| Flash point (° C.) | 89 | 92 | 159 | Impossible to measure |
| Dynamic viscosity (40° C., $mm^2/s$) | 3 | 4 | 24 | 1 |
| Adhesion amount (250° C., mg) | 2.2 | 9.2 | 4.6 | 2.2 |
| Adhesion amount (300° C., mg) | 1.2 | 6.5 | 3.7 | 1.3 |
| Friction force at 250° C. (kgf) | 3 | 2.5 | 3.1 | 7.2 |
| Friction force at 300° C. (kgf) | 4 | 3 | 4 | 10.1 |

*1 and *2 are the same as those shown in Table 4. The other components are the same as those shown in Table 1.
*3: A water soluble type relase agent and the balance, 0.05% by weight, was a wax, an emulsifier or the like.

(B) Production Method

Same as described in Example 1, except that the wettability improving additives were mixed before the solvents were added.

(C) Measurement Method of Flash Point

The measurement was carried out by Cleveland Open method for Example 9 and Comparative Example 6, and by Pensky-Martin method for Examples 6, 7, 8, 10, and 11 and Comparative Examples 4 and 5.

(D) Measurement Method of Dynamic Viscosity

Same as described in Example 1.

(E) Measurement Method of Adhesion Amount

The preparation and measurement of the adhesion amount were the same as described in Example 1, and the testing conditions were as shown in the following Table 6.

TABLE 6

| | Oil type | Water-soluble |
|---|---|---|
| Release agent solution | Undiluted solution | Solution diluted by 80 times |
| Spraying amount (cc) | 0.3 | 30 |
| Air pressure (MPa) | 0.3 | 0.3 |
| Liquid pressure (MPa) | 0.003 | 0.2 |

(F) Measurement Method of Friction Force

The friction force test method was the same as Example 1 and the friction force measurement conditions were the same as described in Table 3.

(G) Collective Results of the Measurement (Effect of Wettability Improving Additive)

In comparison of Example 6 (containing the wettability improving additive) with Comparative Example 4 (without the wettability improving additive); Example 7 (containing the wettability improving additive) with Comparative Example 5 (without the wettability improving additive); and Example 8 (containing the wettability improving additive) with Comparative Example 6 (without the wettability improving additive), the wettability improving additives were found considerably increasing the adhesion amounts and lowering the friction force.

Release agents cannot necessarily be sprayed evenly to die surface of actual machine. There are some concealed die portions which are wetted with a small amount of oil droplets, in which cases excellent releasing property can be exhibited by the release agents of Examples 6 to 11 with which show a high ability in the adhesion amount. The wettability improving additives are effective not only in the release agents of Examples 6, 7, 8, and 10 having viscosity in the range of 3 to 5 $mm^2/s$. In addition, the additives are also effective in the release agent of Example 9 with viscosity as high as 24 $mm^2/s$. The water soluble type release agent of Comparative Example 7 for reference has friction force of 10 kgf at 300° C., which is a limit for use, while the oil type release agents have friction force in the range of 1 to 3 at 300° C. kgf and they are usable.

The release agents of the invention containing the wettability improving additives are effective to increase the adhesion amount on the die surface. Sometimes, the release agent mist is hardly spread to result in occurrence of soldering at fine parts of the die. The release agent having high adhesion property is highly possibly to avoid such a problem. It can be said that the oil type release agents of the invention are excellent from this point of view. Also, since the adhesion efficiency is high, the release agents are usable in a small amount without making the adhered oil film thick. They are also usable as release agents with low viscosity and excellent in spraying property even if diluted with the above-mentioned component (a).

EXAMPLE 12

Next, the spray unit for evenly applying the oil type release agents of the invention will be described. The unit is as explained above. The casting qualities were compared in Example 12 by using an actual machine.

The following Table 7 shows the properties of products obtained by aluminum die casting using the release agents of Examples 13 to 16 and Comparative Examples 8 and 9 and the above-mentioned spray unit. In this case, the release agent of Example 4 was used for Examples 13 and 14; the release agent of Example 6 was used for Examples 15 and 16; the release agent of Comparative Example 7 was used for Comparative Example 8; and the release agent of Comparative Example 4 was used for Comparative Example 9. As shown in FIG. 1, the die employed in Example 12 was able to make two products at the same time and had a casting structure composed of upper and lower slides in a cavity part which was formed with movable and fixed dies.

The spray of the oil type release agent to the cavity section was carried out by attaching the spray unit of the invention to an automatic spray unit. Also, exclusive spray unit (shown in FIG. 3) and a pressurizing delivery unit (shown in FIG. 4) were used for oil type release agents. Further, the release agents were pumped up by a pump and sent at a low pressure of 0.02 to 0.05 MPa to the spray unit. The oil type release agents were sprayed by air used in a plant and applied in a small amount to the die surface.

2) Less porosity in the die casting product;

3) Small spray amount which contributes to short spraying time;

4) Excellent controllability of the delivery pressure which results in stable spray amount per each nozzle;

5) Less daily work in controlling spray amount because of less fluctuation of the spraying amount;

6) Same or better in the necessity of daily maintenance, retention of size precision, and occurrence of cracking in dies; and 7) Excellent in the maintenance of dies and precision.

It is not intended that the invention be limited to the above illustrated embodiments. Modifications and substitutions to specific process conditions and constitutional components can be made without departing from the spirit and scope of the invention. For example, in the above Examples, although the tube for air introduction and the tube for release agent introduction are arranged face to face at two points, these tubes may be installed face to face at three or more points. In this connection, it is desired that these tubes are arranged on the opposite to each other as evenly as possible. With arrangement in such a manner, the release agent can be sprayed more evenly to the die from the tip ends of spray nozzles. The wavy patterns, gas amount left in a product, and application amount can be improved.

TABLE 7

| | | | | Quality (without shot process) | | | | | |
|---|---|---|---|---|---|---|---|---|---|
| | | Type of release agent | Facility | Score | Burn on | Rippled surface | Wavy patterns | Occurrence of burr | Gas amount in the product (cc/100 gAl) |
| Examples | 13 | Oil type | *1 | Usable | Good | Usable | Good | Good | 22.1 |
| | 14 | agent | *2 | Good | Good | Good | Good | Good | 14.4 |
| | 15 | Oil type | *3 | Excellent | Good | Good | Good | Good | 15.1 |
| | 16 | agent containing wettability improving agent | *4 | Good | Good | Good | Good | Good | 16.9 |
| Comparative Examples | 8 | Water-soluble type agent | *5 | Usable | Problematic | Usable | Good | Problematic | 23.3 |
| | 9 | Oil type agent | *5 | Usable | Good | Usable | Problematic | Good | 25.2 |

| | | Workability | | | | Maintenance and precision of die | | |
|---|---|---|---|---|---|---|---|---|
| | | Spraying | | Spreading | | | | |
| | | amount (spraying amount) (cc/1 shot) | Spraying time (second) | property of release agent (Spraying evenly) | Controllability of pressurized delivery unit | Daily maintenance easiness | Rentention of dimensional tolerance | Cracking of die |
| Examples | 13 | 2.4 | 0.4 | Good | Good | Good | Excellent | Excellent |
| | 14 | 1.8 | 0.2 | Good | Excellent | Good | Excellent | Excellent |
| | 15 | 1.8 | 0.2 | Excellent | Excellent | Good | Excellent | Excellent |
| | 16 | 1.8 | 0.2 | Excellent | Excellent | Good | Excellent | Excellent |
| Comparative | 8 | 200 | — | Usable | Usable | Usable | Usable | Usable |
| Examples | 9 | 3.4 | 0.4 | Usable | Usable | Good | Excellent | Excellent |

*1: Employing spray unit for water-soluble release agent + spray unit shown in FIG. 3.
*2: Employing spray unit for water-soluble release agent + pressurized delivery unit shown in FIG. 4.
*3: Employing spray unit for water-soluble release agent + spray unit shown in FIG. 3 + pressurized delivery unit shown in FIG. 4.
*4: Employing wettability improving agent and spray unit for water-soluble release agent.
*5: Employing spray unit apparatus for water-soluble release agent.

From the results shown in Table 7, the release agents (the former) of Examples 13 to 16 were found to be better or excellent in following points as compared with the release agents (the latter) of Comparative 8 and 9:

1) Excellent releasing performances of galling, soldering, flow line, metal wavy and occurrence of burr presumably due to excellent spreading property of the agent;

In the above-mentioned Example 12, the tip end position of the oil face in the tank at the time of stopping spraying is set between the upper face position at the time when the spray nozzles are in waiting mode and the lower limit position at the time when the release agent is sprayed by the spray nozzles. However, it is not limited as described in this Example. The tank for the release agent may not be installed between the positions and the tip end position $L_3$ of the oil face of the release agent may be set at the position by applying the pressure. With such conditioning, in the case where the release agent is not sprayed, the stopping position (rising limit) of the spray unit is above the oil surface position and therefore, the release agent does not drip. On the other hand, in the case where the release agent is going to be applied, since the spray units are stopped at stopping position, which is the lower limit of spray unit, the pressure is sufficient for causing spontaneous drip of the oil type release agent. Accordingly, no air spot is formed in hydraulic hoses and spraying of the oil type release agent by air pressure in a plant can be carried out evenly with suppressed unevenness.

(III) EXAMPLE 17 AND COMPARATIVE EXAMPLES 10 and 11

Hereinafter, Example 17 will be described together with Comparative Examples 10 and 11.

(A) Components and Test Results

The following Table 8 shows the components, mixing ratios, and test results of oil type release agents of Example 17 and Comparative Examples 10 and 11.

TABLE 8

| | Example | Comparative Examples | |
|---|---|---|---|
| | 17 | 10 | 11 |
| Components (% by weight) | | | |
| Water | 0 | 0 | 0 |
| Solvent | 88 | 89.5 | 89 |
| High viscosity mineral oil | 5 | 5 | 5 |
| Silicone oil | 5 | 5 | 5 |
| Rapeseed oil | 0.5 | 0.5 | 0.5 |
| Organic molybdenum | 0.5 | 0 | 0.5 |
| Phenol type antioxidant | 0.5 | 0 | 0 |
| Amine type antioxidant | 0.5 | 0 | 0 |
| Physical values | | | |
| Flash point (° C.) | 92 | 92 | 92 |
| Dynamic viscosity (40° C., $mm^2/s$) | 5 | 4 | 5 |
| Laboratory oxidation test, deterionation time (minute) | 890 | 15 | 240 |
| Friction force at 350° C. (kgf) | 4 | 8 | 5 |
| Friction force at 400° C. (kgf) | 9 | Impossible to measure *3 | Impossible to measure *3 |
| Capability for actual apparatus | | | |
| Continuous castability | 220 time or more | 5 times | 10 times |

*1: Trade name: Lasmit BHT, manufactured by Daiichi Kogyo Seiyaku Co., Ltd.
*2: Trade name: HiTEC-569, manufactured by Afton Chemical and the other components are the same as those shown in Table 1.
*3: Impossible to measure since solidified aluminum did not slide on the test stand and deposited.

(B) Production Method

The production was carried out as described in Example 6, except that the antioxidant was used in place of the wettability improving additive of Example 6.

(C) Measurement of Flash Point

The flash point of each agent was measured in the same manner as described in Example 1.

(D) Measurement of Dynamic Viscosity

The dynamic viscosity of each agent was measured in the same manner as described in Example 1.

(E) Laboratory Oxidation Test, ROBT Method

According to JIS-K-2514, each agent was sampled into a closed type rotary pump and oxygen gas was then sealed. Oxidation was carried out at 150° C. and the time taken to abruptly decrease oxygen pressure was measured.

(F) Measurement Method of Friction Force

The testing method of friction force and the measurement conditions were the same as described in Example 1.

(G) Collective Results of Measurement (Effect of Antioxidant)

In Example 17 and Comparative Examples 10 and 11, the flash point (° C.), the dynamic viscosity ($mm^2/s$) at 40° C., the laboratory oxidation test, the laboratory friction force test at 350° C. and 400° C., and measurement of continuous castability using an actual die casting machine were carried out to find the results as shown in Table 8.

In comparison of the results of Example 17 (containing antioxidant) with those of Comparative Example 11 (containing no antioxidant), from a viewpoint of the laboratory test, the measured value (deterioration time) of Comparative Example 11 was 240 minutes, meanwhile it was 890 minutes for Example 17, showing durability as much as about 4 times and less deterioration. Accordingly, in the case of Example 17, it was confirmed that the antioxidants suppressed the oxidation deterioration of the oil type release agent.

From a viewpoint of the friction force test, the friction force of Comparative Example 11 was 5 kgf at 350° C., which is sufficiently low for practical use. However the agent caused soldering at 400° C. and deposited. On the other hand, in Example 17, the friction force is as low as 9 kgf even at 400° C. The agent was found apparently excellent in the high temperature lubricating property as compared with the agent of Comparative Example 11. Accordingly, in the case of Example 17, it was confirmed that the antioxidant showed the effect and prevented the soldering.

According to the above mentioned two kinds of experiments, it is assumed that the antioxidants can delay the oxidation deterioration of the components of the oil type release agent at a high temperature. Because of this delay, the antioxidants contribute to retention of the oil film thickness. Thus the friction resistance is kept at low level because of the thick oil film.

On one hand, when the release agent of Comparative Example 11 was evaluated using an actual die casting machine, the soldering occurred at the 10th time to make continuous casting impossible. In the case of Example 17, continuous casting could be continued 220 or more times. As a result, it was confirmed that the antioxidants contributed to decrease of soldering and increase of the times of the continuous casting. In the case of the actual machine employed for this case, the temperature of the core pin was 410° C. immediately after the product was taken out. However, in the case of combination of the actual machine and Comparative Example 11, the continuous casting at 380° C. was the limit. According to the results, it can be said that addition of the antioxidant improves the durability to 30 degree higher side.

Further, to ensure the lubricating property at low to middle temperature areas, the organic molybdenum was added in Example 17 and Comparative Example 11. On the other hand, no organic molybdenum was added in Comparative Example 10. The oxidation stability of Comparative Example 11 was slightly improved as compared with that of Comparative Example 10. Friction at 350° C. was slightly decreased in the laboratory friction test. The number of casting times was slightly increased. Accordingly, the results showed the organic molybdenum had an auxiliary effect on oxidation prevention. However the effect was not so much significant as compared with those of phenol type or amine type antioxidants.

EXAMPLE 18

Hereinafter, a method of setting mixing ratio of a solvent according to the second invention will be described.

As being made clear from FIG. 7, the flash point of a release agent can be changed easily to adjust the Leidenfrost phenomenon temperature. The investigations carried out by the inventors for accomplishing the invention made it clear that there are correlations of the Leidenfrost phenomenon temperature L with the flash point F (reference to the equation (1)) and the highest use temperature (S) (reference to the equation (2)) of oil type release agents. The correlations may be defined as follows:

$$S+80=L \quad (1)$$

$$L=4.4\times F+36 \quad (2)$$

TABLE 9

| Component | Specimen 1 | Specimen 2 | Specimen 3 |
|---|---|---|---|
| First solvent | 80.1 | 71.2 | 62.3 |
| Low viscosity mineral oil | 8.9 | 26.7 | 44.5 |
| High viscosity mineral oil | 5 | 5 | 5 |
| Silicone oil | 5 | 5 | 5 |
| Rapeseed oil | 0.5 | 0.5 | 0.5 |
| Organic molybdenum | 0.5 | 0.5 | 0.5 |
| Flash point (° C.) | 95 | 102 | 105 |

1) The Leidenfrost phenomenon temperature L was calculated by interpolating an expected value of the highest use temperature S in the equation (1). And then the calculated temperature L was interpolated in the equation (2) to calculate the flash point F required for the oil type release agent.

2) Next, three types of release agents (specimen 1, specimen 2, specimen 3) were produced by changing mixing ratios of the solvent and mineral oils in the compositions. The Table 9 shows the components and flash points of those three specimens. The recommended mixing ratios were 80%, 70%, and 60% of the solvent.

Figure 9:
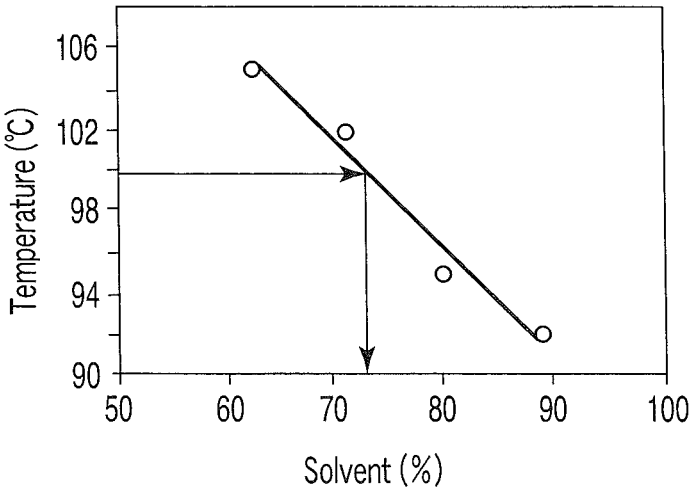
FIG. 9 is a characteristic graph showing the correlation between the solvent concentration and the flash point.

3) After that, the flash points of these three kinds of release agents were measured and as shown in FIG. 9, a graph was produced for the correlation of the solvent (%) and the flash point.

4) Further, the needed solvent (% by volume) was calculated using the flash point (F) which was calculated as described in 1) from the graph.

5) Next, a light component (the low viscosity mineral oil and/or the synthetic oil) was calculated from the balance calculated by subtracting the ratios of the solvent and the additive.

In the manner as described above, in Example 18, the mixing ratio of the solvent and the mineral oil was properly set to avoid the Leidenfrost phenomenon.

In Example 18, the case of using the solvent and mineral oil was described. However the invention may include the case of using a solvent and a synthetic oil; or the case of using a solvent, a mineral oil, and a synthetic oil; or the case of using two kinds of solvents.

In the above-mentioned Example, the oil type release agent was described based on the first invention. However the combination of the respective components, mixing ratios and spray condition may properly be set to use the following oil type release agent. That is, the oil type release agent contain 50 parts by weight or more in total of 1 or more kinds of components selected from a group consisting of solvents, mineral oils, synthetic oils, fats and oils, aliphatic acids, and aliphatic acid esters, 40 parts by weight or less of silicone oil, and additives having lubricating function, has the flash point of 50 to 250° C. and dynamic viscosity of 2 to 50 $mm^2/s$ at 40° C. With such a constitution, quenching is not caused unlike a conventional case and the agent as the oil type release agent has high heat resistance scarcely causes soldering, resulting in possibility of prolongation of the die life. Also, the use of such an oil type release agent makes it possible to form an even and thin film on the die surface with a small amount, galling and soldering of the die casting product on the die and blistering at the time of thermal treatment can be suppressed. The types and properties of the respective components are as described in the case of the above-mentioned oil type release agents.

The oil type release agent of the invention is suitable for lubricating die surfaces by spraying a lubricant during die casting and for lubricating plunger chips at the time of pouring molten metal. The oil type release agent of the invention is suitable for automatic continuous spray of undiluted agent liquid with small amount in the continuous production.

What is claimed is:

1. An oil release agent, containing:

(a) solvents having dynamic viscosity of 2 to 10 $mm^2/s$ at 40° C. and a flash point in the range of 70 to 170° C. in a range of 70 to 97 parts by weight based on a total amount of the oil release agent;

(b) high viscosity mineral oils and/or synthetic oils having dynamic viscosity of 100 $mm^2/s$ or higher at 40° C. in a range of 1 to 10 parts by weight based on the total amount of the oil release agent;

(c) a silicone oil having dynamic viscosity of 150 $mm^2/s$ or higher at 40° C. in a range from greater than 0 parts by weight to and including 15 parts by weight based on the total amount of the oil release agent; and (d) additives having a lubricating function in a range of 1 to 5 parts by weight based on the total amount of the oil release agent, wherein a flash point of the agent is in the range of 70 to 170° C., and a dynamic viscosity of the agent is 2 to 30 $mm^2/s$ or higher at 40° C.

2. The oil release agent according to claim 1, wherein the component (a) consists of the solvents and at least one selected from synthetic oils and low viscosity mineral oils having dynamic viscosity of less than 100 $mm^2/s$ at 40° C. and is contained in a range of 70 to 97 parts by weight based on the total amount of the oil release agent.

3. The oil release agent according to claim 1, wherein a spray amount to a die is 20 cc or less per one shot on the basis of undiluted liquid of the agent.

4. The oil release agent according to claim 2, wherein a spray amount to a die is 20 cc or less per one shot on the basis of undiluted liquid of the agent.

5. The oil release agent according to claim 1, further containing a wettability improving additive.

6. The oil release agent according to claim 5, further containing an acrylic copolymer or an acryl-modified polysiloxane at the flash point of 100° C. or lower as the wettability improving additive in a range of 0.1 to 3 parts by weight based on the total amount of the oil release agent.

7. The oil release agent according to claim 1, further containing antioxidants.

8. The oil release agent according to claim 1, which further comprises one or more antioxidants selected from the group consisting of amine antioxidants, phenol antioxidants, and cresol antioxidants in a range of 0.2 to 2 parts by weight based on the total amount of the oil release agent.

9. The oil release agent according to claim 1, wherein the silicone oil is alkyl silicone oil having alkyl-aralkyl or alkyl groups having longer chain than dimethyl.

10. The oil release agent according to claim 1, wherein the release agent is obtained by previously mixing one or more components among the respective components (a), (b), (c), and (d) for obtaining a mixture, and then mixing the remaining components with the mixture.

11. The oil release agent according to claim 5, wherein the release agent is obtained by previously mixing one or more components among the respective components (a), (b), (c), (d) and the wettability improving additive for obtaining a mixture, and then mixing the remaining components with the mixture.

12. The oil release agent according to claim 6, wherein the release agent is obtained by previously mixing one or more components among the respective components (a), (b), (c), (d) and the wettability improving additive for obtaining a mixture, and then mixing the remaining components with the mixture.

13. The oil release agent according to claim 7, wherein the release agent is obtained by previously mixing one or more components among the respective components (a), (b), (c), (d) and the antioxidant for obtaining a mixture, and then mixing the remaining components with the mixture.

14. The oil release agent according to claim 8, wherein the release agent is obtained by previously mixing one or more components among the respective components (a), (b), (c), (d) and the antioxidant for obtaining a mixture, and then mixing the remaining components with the mixture.

15. The oil release agent according to claim 1, wherein the solvents are petroleum based solvents containing saturated components.

* * * * *